United States Patent [19]

Bone et al.

[11] Patent Number: 5,047,757

[45] Date of Patent: Sep. 10, 1991

[54] METHOD OF ADDRESSING A FERROELECTRIC LIQUID CRYSTAL DISPLAY

[75] Inventors: Matthew F. Bone, Bishop'Stortford; Ian Coulson, Maidenhead; Johnathan R. Hughes, St. John's; Peter W. Ross, Stanstead; Frances C. Saunders, Suckley; Paul W. H. Surguy, Uxbridge, all of England

[73] Assignees: STC plc; The Secretary of State for Defence; Thorn EMI, London, England

[21] Appl. No.: 239,994

[22] Filed: Sep. 2, 1988

[30] Foreign Application Priority Data

Sep. 4, 1987 [GB] United Kingdom ..... 8720856

[51] Int. Cl.[5] ..... G09G 3/36; G09G 3/00

[52] U.S. Cl. ..... 340/784; 340/805; 359/56

[58] Field of Search ..... 340/784, 805; 350/330, 350/330 R, 332, 333, 334; 358/241

[56] References Cited

U.S. PATENT DOCUMENTS

| | | | |
|---|---|---|---|
| 4,591,585 | 2/1986 | Stein et al. | 340/805 |
| 4,728,947 | 3/1988 | Ayliff et al. | 340/805 |
| 4,850,676 | 7/1989 | Yazaki et al. | 340/805 |

FOREIGN PATENT DOCUMENTS

| | | | |
|---|---|---|---|
| 2173335 | 10/1986 | United Kingdom | 340/784 |

*Primary Examiner*—Jeffery A. Brier
*Assistant Examiner*—M. Fatahiyar
*Attorney, Agent, or Firm*—Fleit, Jacobson, Cohn, Price, Holman & Stern

[57] ABSTRACT

A method is disclosed for addressing a matrix-array type liquid crystal layer. The cell has a plurality of pixels which are defined by regions of overlap between two sets of electrodes which sandwich a liquid crystal layer, each pixel having two states. The response time for switching between the two states is dependent upon the voltage across the liquid crystal layer, with a minimum occurring at a particular voltage. The method includes applying a strobe waveform to a selected member of a first set of the electrodes while a data waveform is applied to each member of the second set of electrodes. A waveform for switching a pixel defined by the selected member comprises a switching pulse of a given voltage magnitude and given duration. A waveform for not switching a pixel defined by the selected member comprises a non-switching pulse of a voltage magnitude greater than the given voltage magnitude of the switching pulse and a duration less than the given duration of the switching pulse.

7 Claims, 12 Drawing Sheets

METHOD OF ADDRESSING A FERROELECTRIC LIQUID CRYSTAL DISPLAY

This invention relates to the addressing of ferroelectric liquid crystal cells.

In a matrix-type display device comprising a liquid crystal layer, the pixels of the matrix are defined by areas of overlap between members of a first set of electrodes on one side of the liquid crystal layer and members of a second set of electrodes on the other side of the liquid crystal layer. An electric field is applied across the molecules of a pixel to determine the optical state of that pixel by the generation of voltages at the member of the first set of electrodes and the member of the second set of electrodes that define the pixel.

For the addressing on a line-by-line basis of a liquid crystal cell comprising a twisted nematic cell between two layers of strip electrodes, a strobe pulse may be applied in turn to the members of the first set of electrodes, termed the row electrodes while data pulses are applied in parallel to the members of the second set of electrodes, termed the column electrodes. These pulses are bursts of alternating potential in order to avoid electrochemical degradation effects, and the alternating potential of the data pulses is arranged to be exactly in phase with the alternating potential of the strobe pulses for data pulses of one data significance, and to be in exact antiphase for data pulses of the other data significance. If the strobe pulse and data pulse voltages respectively alternate between $\pm V_S$ and $\pm V_D$, and if all the row electrodes other than the row electrode currently being strobed with $\pm V_S$ are maintained at 0 volts, then it will be seen that the pixels of the row currently being strobed will have voltages of $\pm(V_S+V_D)$ or $+(V_S-V_D)$ developed across them according to the data significance of the data pulses, while all the remaining pixels will be exposed to $\pm V_D$. The liquid crystal cell exhibits a voltage threshold in its operation, and hence the magnitudes of $V_S$ and $V_D$ are chosen so that the average rms of one period of $\pm(V_S+V_D)$ and $N-1$ of $\pm V_D$ is sufficient to drive the pixel on, but the average rms of one period of $\pm(V_S-V_D)$ and $N-1$ of $\pm V_D$ is insufficient.

A similar sort of voltage threshold effect was reported by N. A. Clark et al in a paper entitled 'Ferroelectric Liquid Crystals Electro-Optics Using the Surface Stabilised Structure' appearing in Mol. Cryst. Liq. Cryst. 1983 Volume 94 pages 213 to 234, and following publication of that paper a number of line-by-line matrix addressing schemes have been described e.g. in UK Patent Applications Nos. GB 2173336A and GB 2173629A. These addressing schemes have not used pulses of alternating potential because the ferroelectric dipole, unlike the induced dipole of a twisted nematic or any other type of non-ferroelectric cell, interacts with an applied electric field in a manner that is different according to whether the applied field points in any given direction or in the exactly opposite direction. For this reason these schemes have used bipolar data pulses acting in conjunction with unipolar or bipolar strobe pulses. The data pulses are conveniently arranged to be charge balanced in order to avoid electrochemical degradation effects and, if unipolar strobe pulses are used steps are taken to restore the requisite long term charge balance, either by periodically changing the polarity of the unipolar strobe pulses or by some other means. Each of these schemes is concerned with choosing strobe and data pulse voltages so that on the one hand a pixel is maintained in, or switched into, one bistable state by the development of a potential difference across the thickness of the pixel of $+(V_S+V_D)$ and is maintained in or switched into, the other bistable state by the development of the oppositely directly potential difference $-(V_S+V_D)$, and so that on the other hand potential differences of $+(V_S-V_D)$, $-(V_S-V_D)$, $+V_D$ and $-V_D$ are none of them sufficient to effect switching.

By way of specific example FIG. 1 depicts the waveforms employed in a line-by-line addressing scheme similar to one of the addressing schemes specifically described in GB 2173629A. This uses symmetric bipolar data pulses 1, 2 to co-act with positive-going and negative-going unipolar strobe pulses 3 and 4. Data is entered line-by-line by applying a strobe pulse to each of a set of row electrodes in turn while the data pulses are applied in parallel to a set of column electrodes. Data pulse 1, arbitrarily designated a data '0' pulse, comprises a voltage excursion to $-V_D$ for a duration $t_s$ followed immediately by a voltage excursion to $+V_D$ for a further duration $t_s$. Data pulse 2, arbitrarily designated a data '1' pulse, is similar to data pulse 1, but the order of the voltage excursions is reversed. Strobe pulse 3 comprises a voltage excursion to $+V_S$ for a duration $t_S$, while strobe pulse 4 comprises a voltage excursion to $-V_S$, also of duration ts In principle the strobe pulses can be synchronised either with the first voltage excursions of the data pulses or with the second voltage excursion; synchronisation with the second voltage excursion is exemplified in FIG. 1. A pixel addressed with the coincidence of a data '0' pulse 1 and a positive-going strobe pulse 3 is exposed to a waveform as depicted at 5 which has a maximum voltage magnitude of $(V_S-V_D)$ and so does not effect switching. A pixel addressed with the coincidence of a data '1' pulse 2 and a positive-going strobe pulse 3 is exposed to a waveform as depicted at 6 which has a maximum voltage magnitude of $(V_S+V_D)$ and so can effect switching from one of the stable states to the other but not switching in the reverse direction. Switching in the reverse direction is accomplished with the aid of the oppositely directed strobe pulse 4, the coincidence of this with a data '0' pulse 1 exposing a pixel to the waveform as depicted at 7 which has a maximum voltage magnitude of $(V_S+V_D)$. However, a pixel addressed with the coincidence of a data '1' pulse 2 and the negative-going strobe pulse 4 is exposed to a waveform as depicted at 8 which has a maximum voltage magnitude of $(V_S-V_D)$ and so does not effect switching.

The switching of a ferroelectric cell pixel is dependent not only upon the voltage to which that pixel is exposed but also upon the duration for which that voltage is maintained. A characteristic is depicted at 10 in FIG. 2 in which log switching voltage duration (response time) is plotted as a function of log switching voltage magnitude. This characteristic separates zone A, the zone in which the switching stimulus is sufficient to effect switching, from zone B, the zone in which the stimulus does not effect switching. For a particular pulse duration $t_s$ there is no apparent problem in choosing appropriate values of the strobe and data pulse voltages $V_S$ and $V_D$ so that $(V_S+V_D)$ lies safely within zone A. Then, by choosing a value of the data pulse voltage $V_D$ that is not too small in relation to the value of the strobe pulse voltage $V_S$, it is evident that it is possible to arrange that $(V_S-V_D)$ lies safely within zone B for a pulse duration $t_s$ It must be noted however that the coincidence of a data '0' pulse 1 and a positive-going strobe pulse 3 does not expose the pixel to an isolated pulse of amplitude ($V_S-V_D$), and duration ts, but rather the waveform 5 in which the pulse of amplitude ($V_S-V_D$) and duration $t_s$ is immediately preceded by a pulse of the same sign of amplitude $V_D$ and also of duration $t_s$. Furthermore it can be seen that, as shown in FIG. 3, if this data '0' pulse were to have been immediately preceded by a data '1' pulse, the pixel is exposed to a waveform 9 comprisinq a pulse of duration $t_s$ and amplitude ($V_S-V_D$) which is immediately preceded by a pulse of duration $2t_s$ and amplitude $V_D$.

Suppose by way of example the values of the strobe and data pulse voltages $V_S$ and $V_D$ are as represented in FIG. 2, then the coincidence of a positive-going strobe pulse 3 with a data '1' pulse 2 exposes the pixel to a waveform 6 whose ($V_S+V_D$) component for a duration $t_s$ is sufficient to provide a switching stimulus corresponding to the operating point 12 lying safely within the switching zone A. An isolated pulse of amplitude ($V_S-V_D$) for duration $t_s$ would provide a switching pulse corresponding to the point 13 lying safely within the non-switching zone B, but, as explained in the preceding paragraph, addressing the pixel by coincidence of positive-going strobe pulse 3 with a data '0' pulse does not produce an isolated ($V_S-V_D$) pulse but the waveform 5, and so the effective pulse corresponds to some real operating point above the level of point 13. If the values of $V_S$ and $V_D$ have been chosen so that $V_S-2V_D$, then $V_D=(V_S-V_D)$, and the effective pulse will provide a real operating point vertically above point 13. In the case that $V_S$ TM $2V_D$ and the data '0' pulse is immediately preceded by a data '1' pulse to produce the waveform 9 of FIG. 3, the effective pulse will provide a real operating point that is vertically above point 13 at the point 14 where the ($V_S-V_D$) abscissa intersects the $3t_s$ ordinate. Depending upon the gradient of the characteristic curve this real operating point may be within the switching zone A (as shown in FIG. 2) rather than, as desired, within the non-switching zone B. Depending upon the precise shape of the characteristic curve of the specific ferroelectric material in question, the choice of $V_S=2V_D$ may be well removed from the ratio giving the best prospect of achieving the requisite discrimination between pixels addressed for switching and those addressed for remaining in the same state. In practice it may be found that problems of obtaining discrimination are eased by choosing to make $V_D$ smaller than $V_S$ by a factor typically in the range four to six, rather than about two. However there are other considerations which militate against using too small a value of $V_D$. One of these considerations is the fact that the data stream provides an alternating potential which tends to stabilise the pixels in their fully switched states, preventing them from relaxing into intermediate stable states which are less optically distinct from each other than the fully switched states. The result is that, as a practical matter, with many ferroelectric liquid crystal media it is difficult or impossible to choose values of $V_S$ and $V_D$ that provide good discrimination between switching with waveforms 6 and 7 of voltage magnitude ($V_S+V_D$) and not switching with waveforms 5 and 8 of voltage magnitude ($V_SV_D$).

It is an object of the present invention to provide a method of addressing a ferroelectric liquid crystal display which at least alleviates the problems outlined hereinbefore.

According to the present invention, there is provided a method of addressing a matrix-array type liquid crystal cell with a ferroelectric liquid crystal layer having a plurality of pixels defined by areas of overlap between members of a first set of electrodes on one side of the liquid crystal layer and members of a second set of electrodes on the other side of the liquid crystal layer, each of said pixels having a first and a second state and a response time for switching between said first and said second state which depends on the voltage across the liquid crystal layer, said response time showing a minimum at a particular voltage, the method including the step of applying a strobe waveform to a selected member of said first set of electrodes while a data waveform is applied to each member of said second set of electrodes wherein a waveform for switching a pixel defined by said selected member comprises a switching pulse of a given voltage magnitude and given duration and a waveform for not switching a pixel defined by said selected member comprises a non-switching pulse of a voltage magnitude greater than said given voltage magnitude of said switching pulse and a duration less than said given duration of said switching pulse.

For the avoidance of doubt, it is hereby stated that in the claims defining the present invention and in the specific description of an embodiment of the present invention, the term 'pulse' is used in the sense of a non-zero voltage excursion which need not have a constant voltage magnitude but is of one polarity.

In contrast to the prior art which discloses methods in which the switching pulse has a greater voltage magnitude than the non-switching pulse, the present invention provides a method in which the non-switching pulse has a voltage magnitude greater than that of the switching pulse. The reason that this is possible is because it has recently been found that some ferroelectric liquid crystal materials exhibit or can be caused to exhibit a characteristic curve of the general form depicted by curve 20 of FIG. 4 which is not monotonic but exhibit$_s$ a minimum, and consequently a positive gradient portion. Thus, in contrast to the prior art which used a characteristic having a negative gradient, the present invention uses the positive gradient portion of a characteristic in which the response time shows a minimum at a particular voltage. This improves the discrimination between the switching and non-switching waveforms.

In particular, in the present invention, pixels addressed by the coincidence of a strobe pulse of voltage magnitude $V_S$ and a data pulse of voltage magnitude $V_D$ can be switched when those pulses are such as to combine to develop a potential of $\pm(V_S-V_D)$ but not be switched when they are such as to combine to develop a Potential of $\pm(V_S+V_D)$.

An embodiment of the invention will now be described, by way of example only, and with reference to the accompanying drawings in which.

Figure 5:
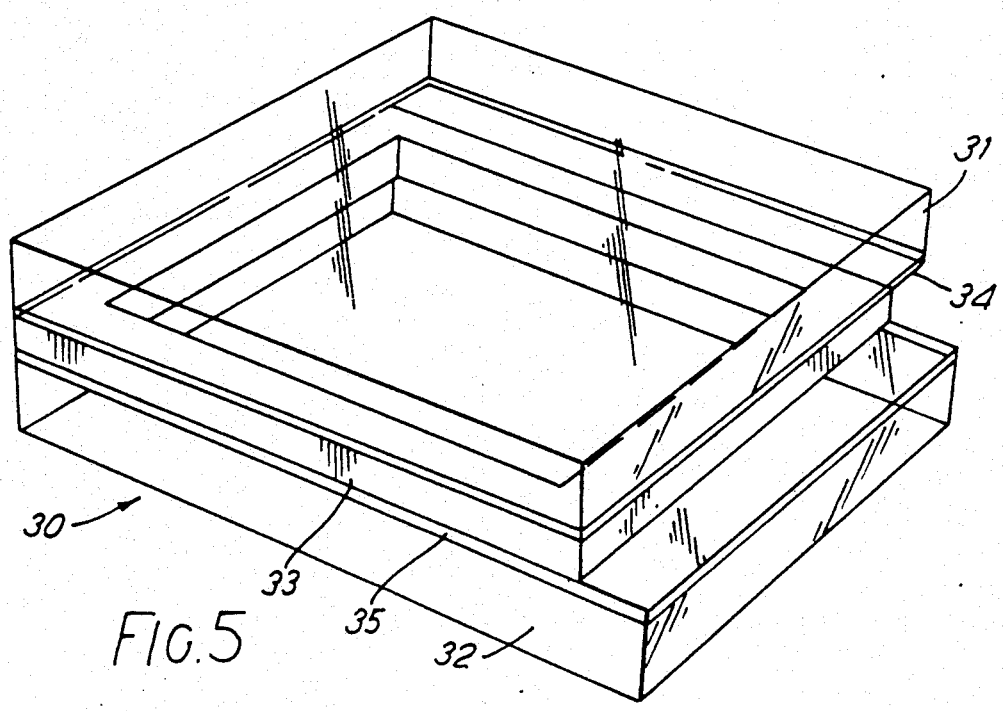
Figure 4:
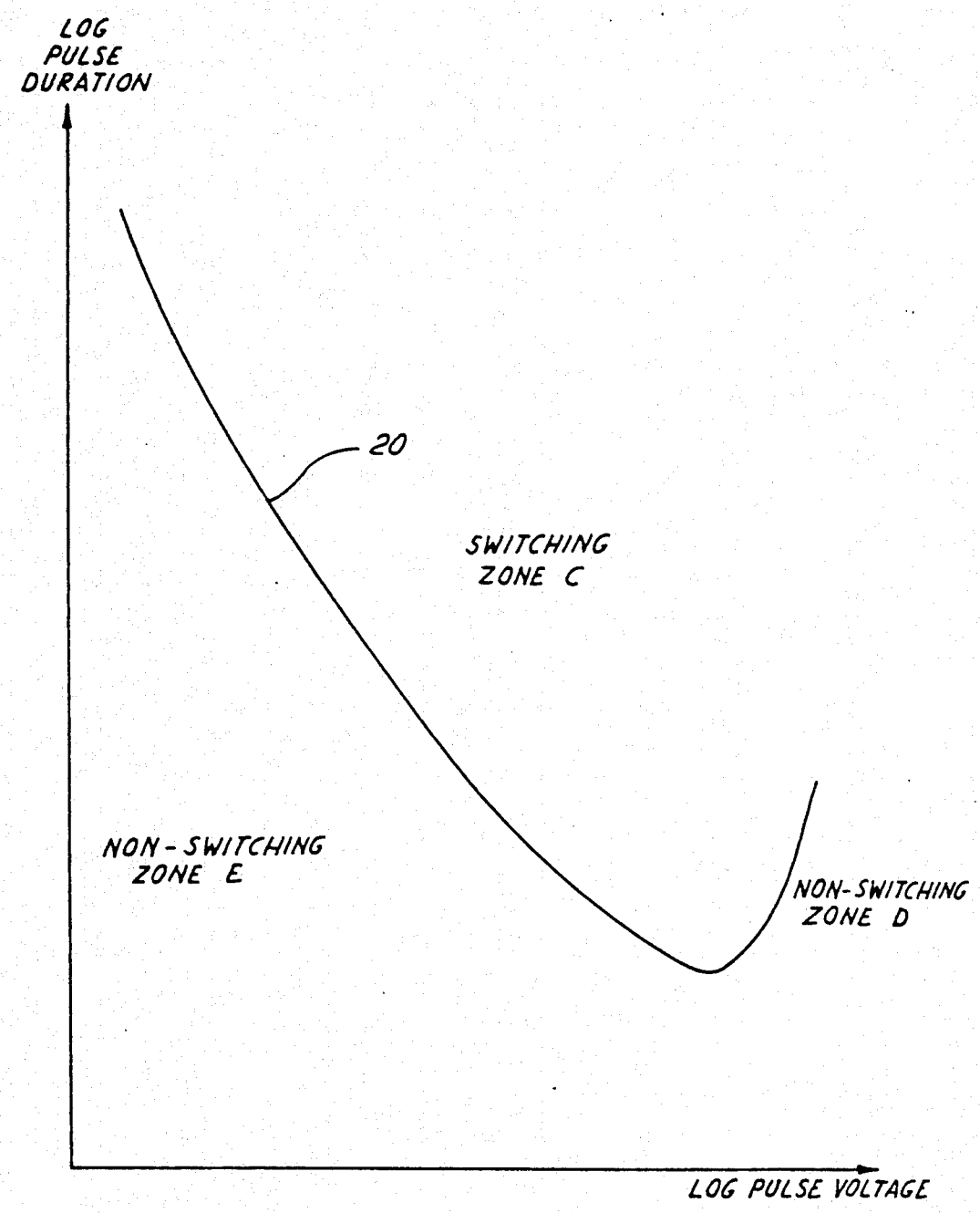
Figure 6:
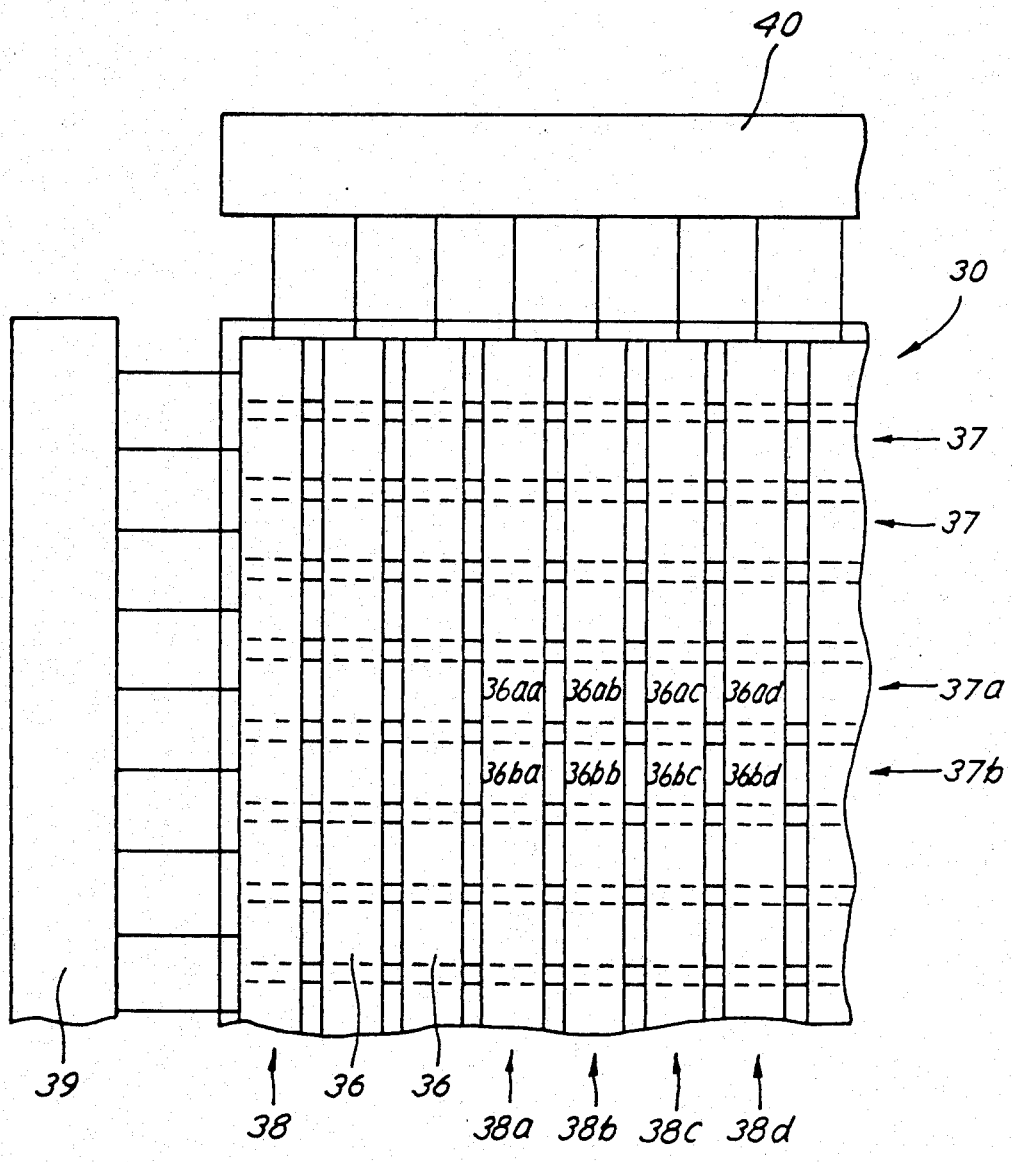
Figure 7:
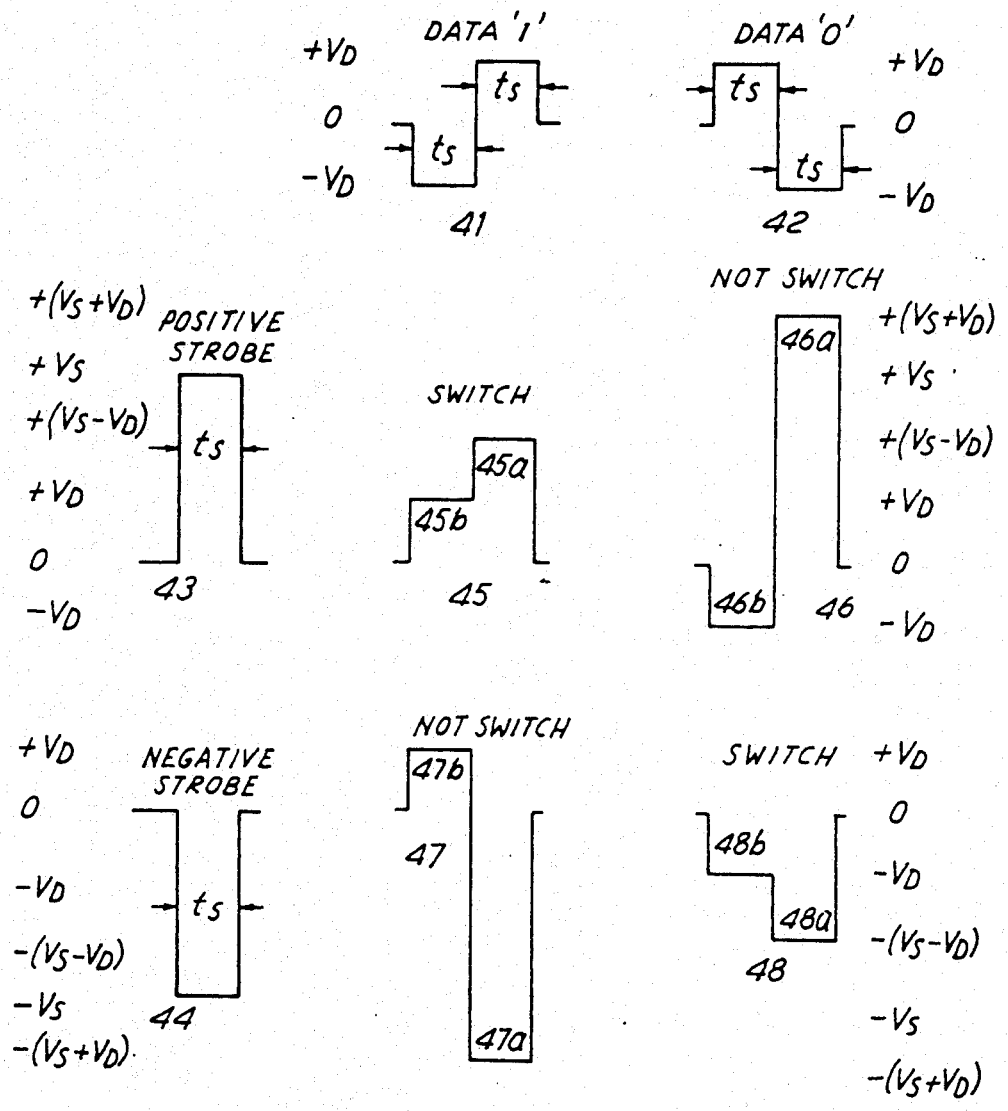
Figure 8:
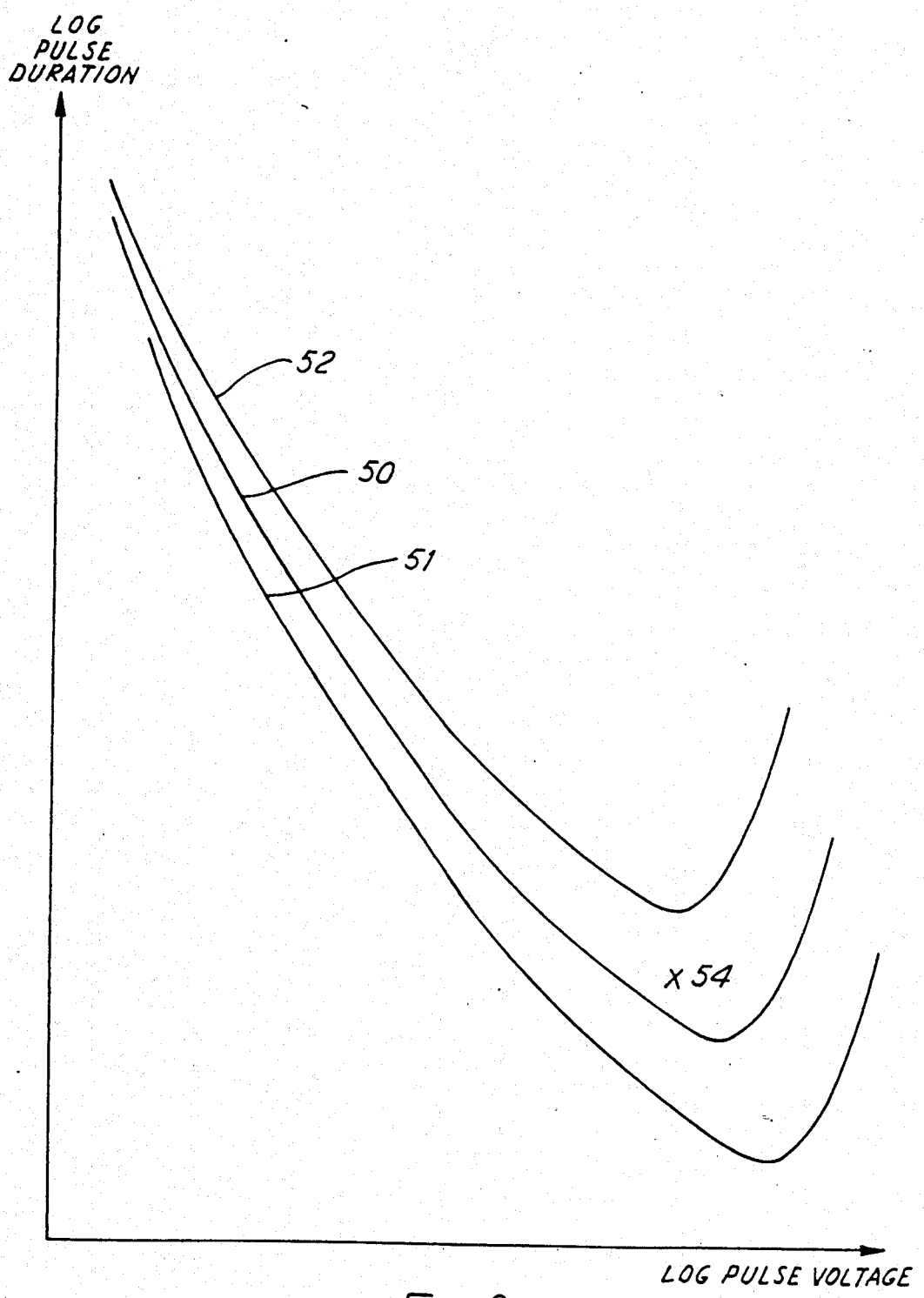
Figure 9:
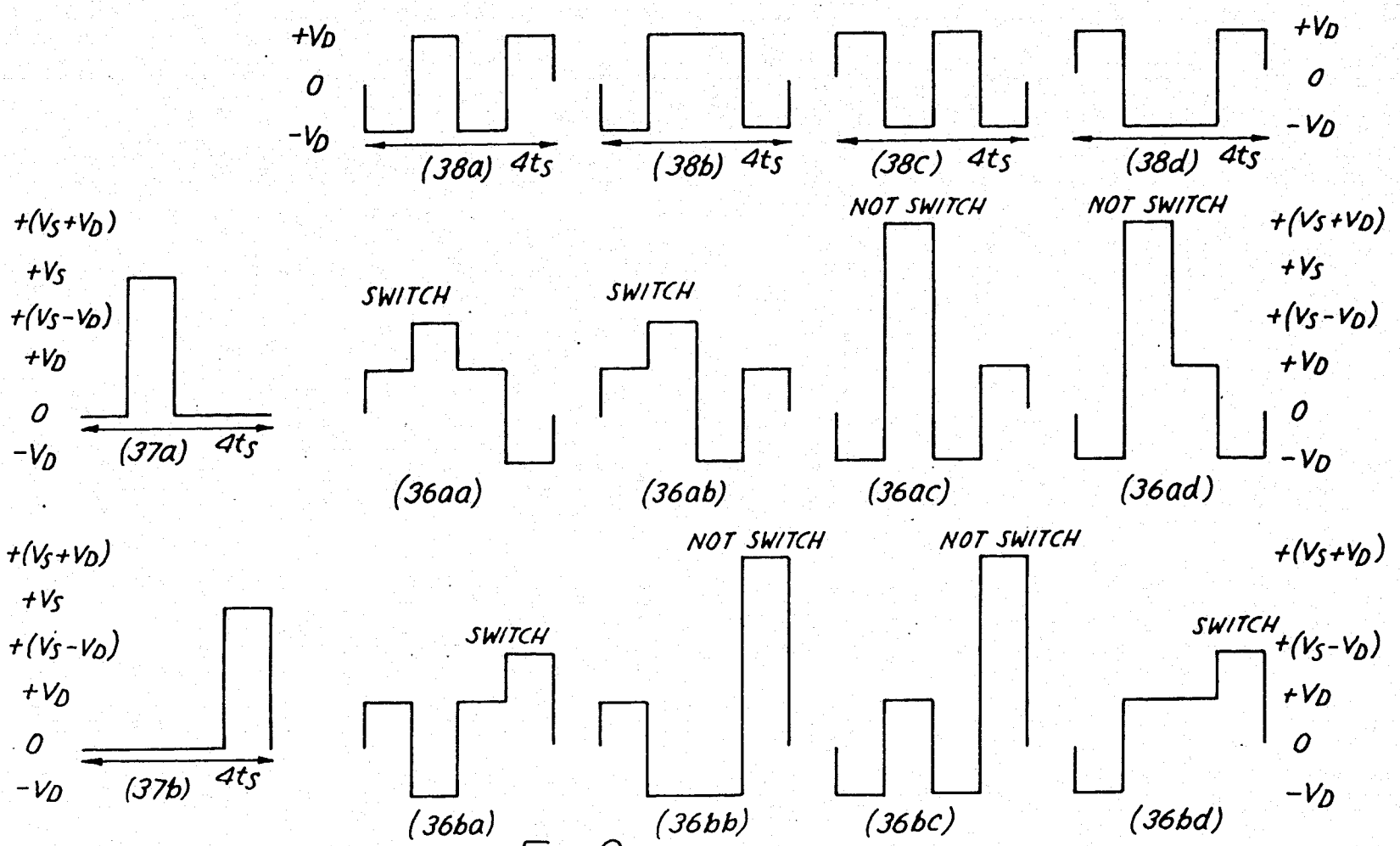
Figure 10:
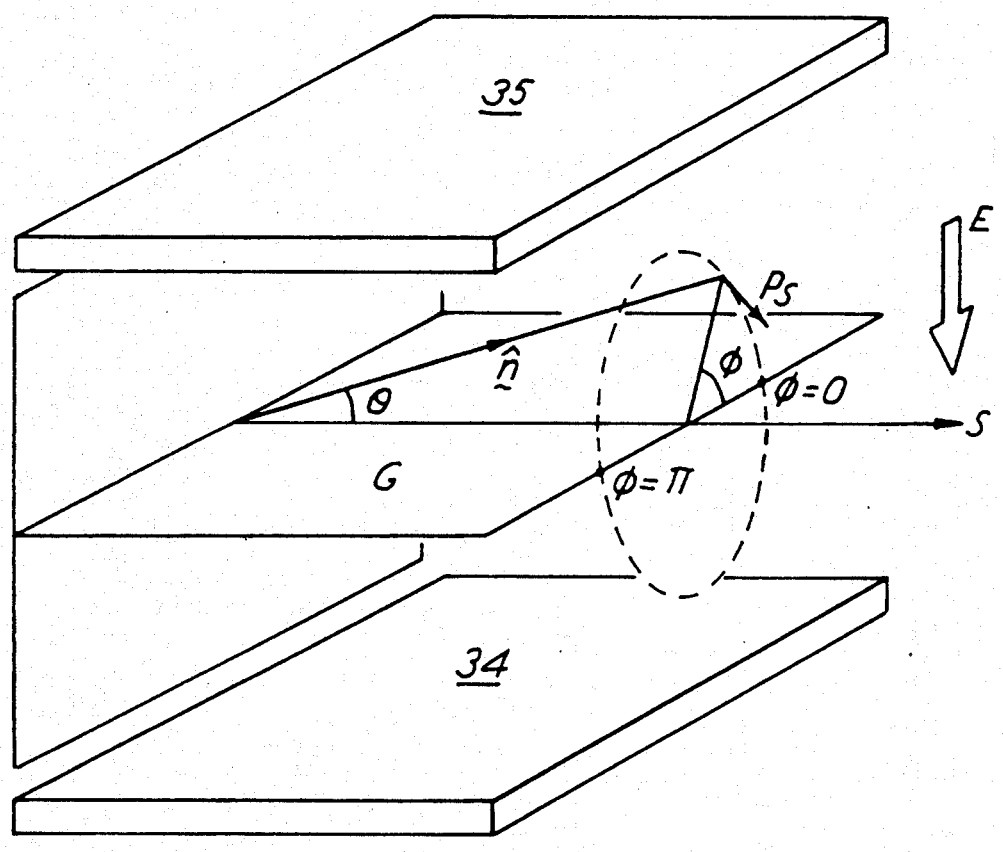
Figure 11:
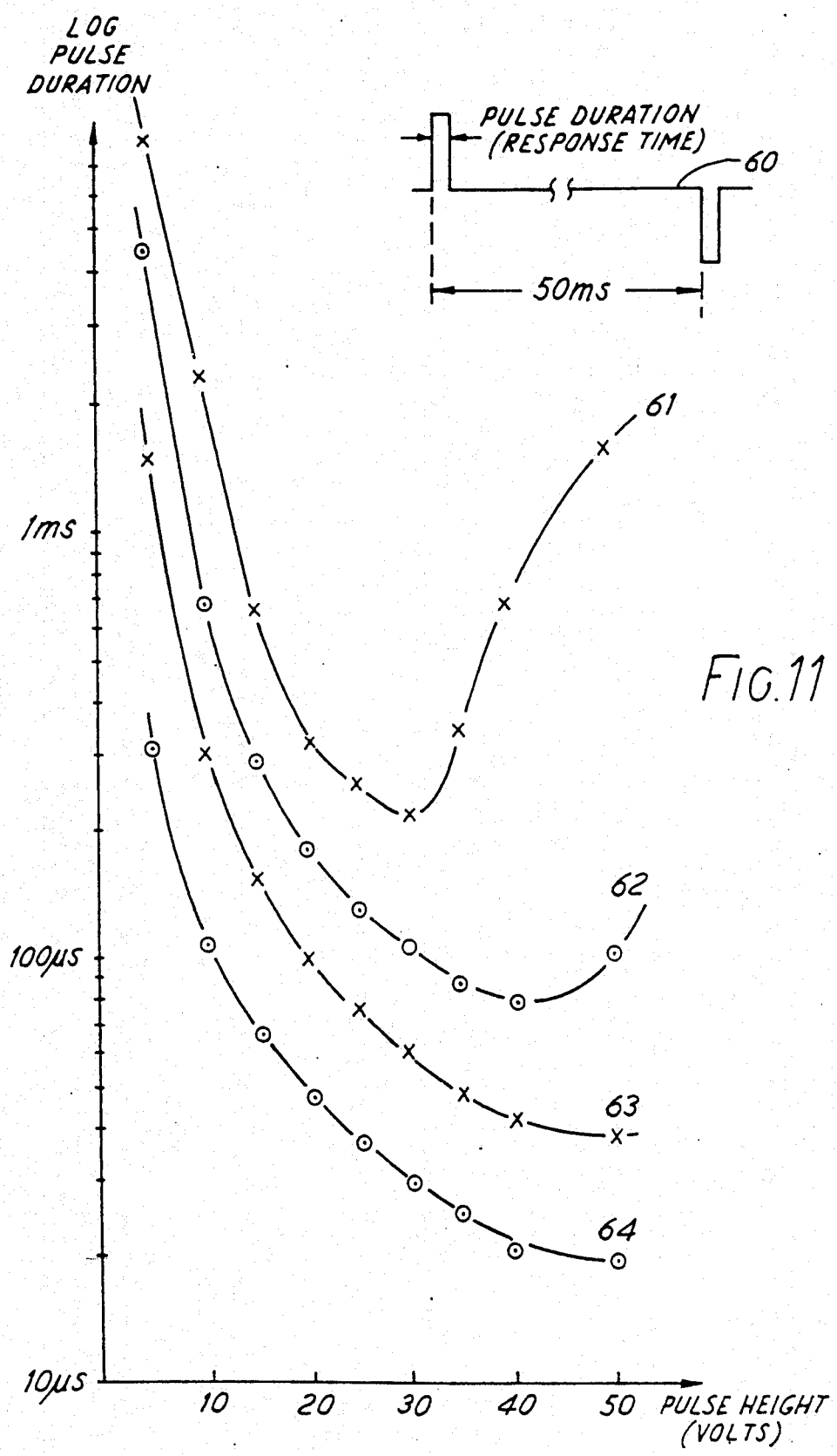
Figure 12:
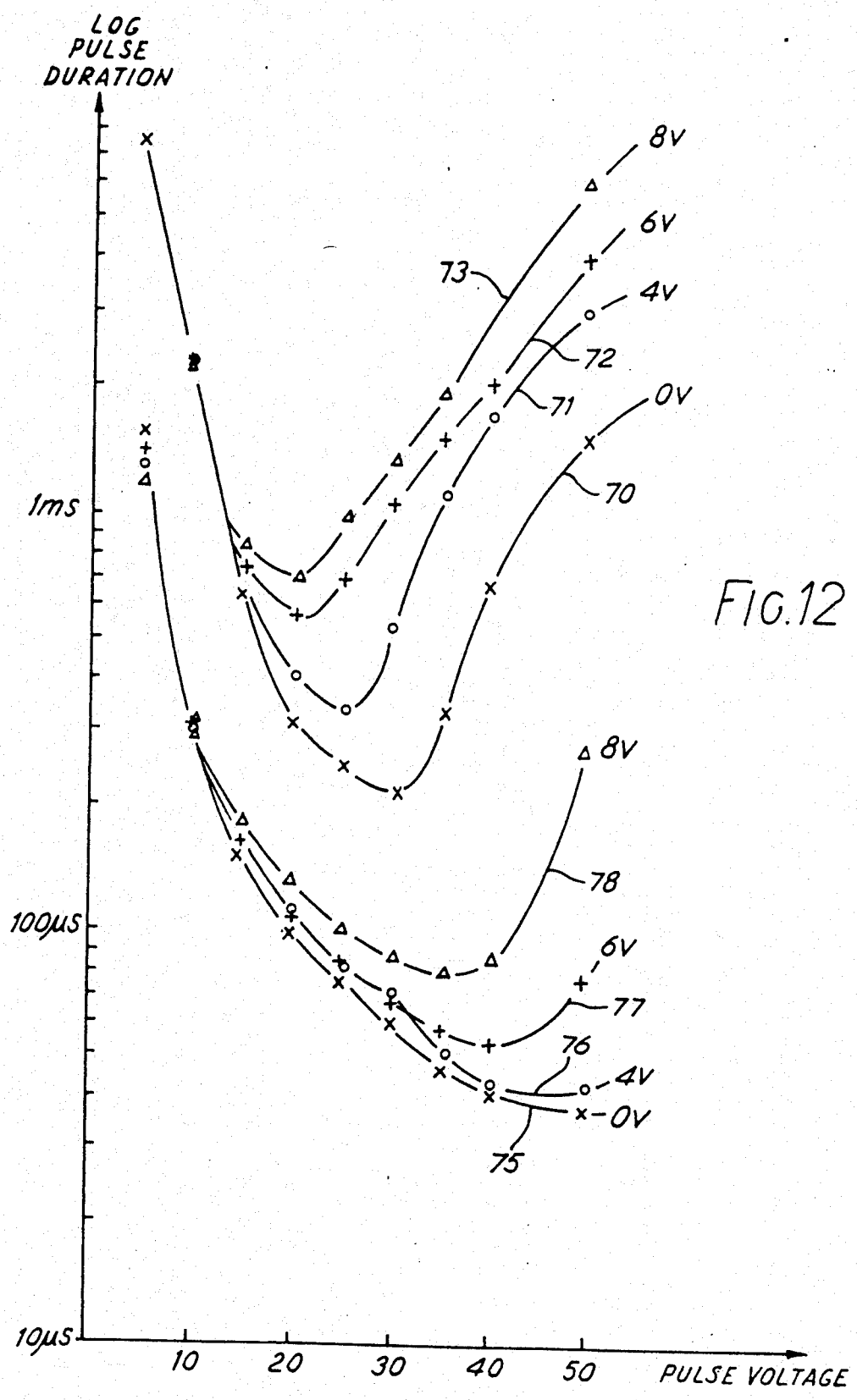
Figure 13:
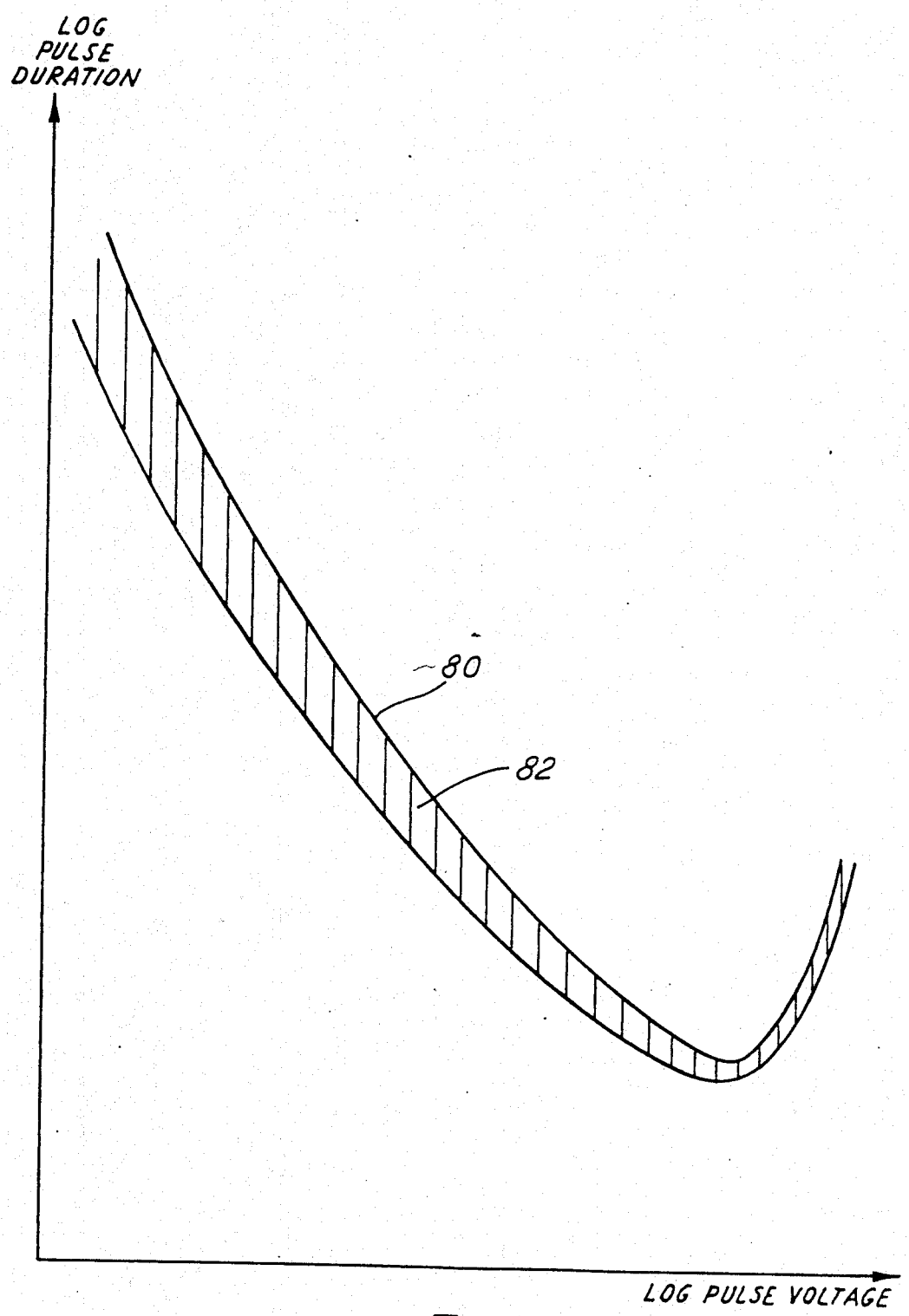

FIG. 4 depicting the switching characteristic of a ferroelectric liquid crystal material;

FIG. 5 depicts a schematic perspective view of a liquid crystal cell;

FIG. 6 depicts a schematic plan view of a liquid crystal cell showing its matrix-array;

FIG. 7 waveforms employed in a method of addressing a liquid crystal cell provided in accordance with the present invention;

FIG. 8 is a graph depicting the switching characteristics of a ferroelectric liquid crystal material;

FIG. 9 depicts waveforms produced in the scheme of FIG. 7;

FIG. 10 shows, for clarity, the definition of the terms used in the theory leading to Equation (1);

FIG. 11 is a graph depicting how the switching characteristic of a particular material varies as a function of $P_s$;

FIG. 12 is a graph depicting how the switching characteristic is modified by the presence of a.c. stabilisation, and FIG. 13 is another graph depicting the characteristic of a ferroelectric liquid crystal material.

Referring now to FIG. 5, this shows a schematic perspective view of a liquid crystal cell 30. An hermetically sealed envelope for a liquid crystal layer is formed by securing together two glass sheets 31 and 32 with a perimeter seal 33. The inward facing surfaces of the two sheets carry transparent electrode layers 34 and 35 of indium thin oxide, and one or sometimes both of these electrode layers is covered within the display area defined by the perimeter seal with a polymer layer (not shown), such as nylon, provided for molecular alignment purposes. The nylon layer is rubbed in a single direction so that, when a liquid crystal is brought into contact with it, it will tend to promote planar alignment of the liquid crystal molecules in the direction of the rubbing. If the cell has polymer layers on both its inward facing major surfaces, it is assembled with the rubbing directions aligned substantially parallel with each other. Before the electrode layers 34 and 35 are covered with the polymer, each one is patterned to define a set of strip electrodes (not shown) that individually extend across the display area and on out to beyond the perimeter seal to provide contact areas to which terminal connection may be made. The thickness of the liquid crystal layer contained within the resulting envelope is determined by a light scattering of polymeric spheres of uniform diameter throughout the area of the cell. Conveniently the cell is filled by applying a vacuum to an aperture (not shown) through one of the glass sheets in one corner of the area enclosed by the perimeter seal so as to cause the liquid crystal medium to enter the cell by way of another aperture (not shown) located in the diagonally opposite corner. (Subsequent to the filling operation the two apertures are sealed). The filling operation is carried out with the filling material heated into its nematic or isotropic phase so as to reduce its viscosity to a suitably low value. It will be noted that the basic construction of the cell is similar to that of for instance a conventional twisted nematic, except of course for the parallel alignment of the rubbing directions.

Typically the thickness of the perimeter seal 33, and hence of the liquid crystal layer, as defined by the polymeric spheres, is between 1.5 to 3 μm, but thinner or thicker layer thicknesses may be required to suit particular applications. A preferred thickness is 2 μm. A suitable material for the filling is the smectic C eutectic marketed by BDH of Poole in Dorset under the designation of SCE 3. This material, which exhibits negative dielectric anisotropy at least over the frequency range from 1 kHz to 40 kHz, on cooling from the isotropic phase passes through the smectic A phase into the smectic C phase. In the case of a 2 μm thick liquid crystal layer confined between the rubbed surfaces, the entry of the material into the smectic A phase causes the smectic layers to be formed with bookshelf alignment (layers extending in planes to which the rubbing direction is normal), and this alignment of the smectic layers appears to be preserved when the material makes the transition into the smectic C phase.

FIG. 6 is a schematic plan representation of part of the matrix-array type liquid crystal cell 30 of FIG. 5. Pixels 36 of the matrix are defined by areas of overlap between members 37 of a first set of row electrodes in the electrode layer 34 and members 38 of a second set of column electrodes in the electrode layer 35. For each pixel, the electric field thereacross determines the state and hence alignment of the liquid crystal molecules. Parallel polarizers (not shown) are provided at either side of the cell 30. The relative orientation of the polarizers determines whether or not light can pass through a pixel in a given state. Accordingly for a given orientation of the polarizers, each pixel has a first and a second optically distinguishable state provided by the two bistable states of the liquid crystal molecules in that pixel.

Voltage waveforms are applied to the row electrodes 37 and column electrodes 38 respectively by row drivers 39 and column drivers 40. The matrix of pixels 36 is addressed on a line-by-line basis by applying voltage waveforms, termed strobe waveforms, serially to the row electrodes 37 while voltage waveforms, termed data waveforms, are applied in parallel to the column electrodes 38. The resultant waveform across a pixel defined by a row electrode and a column electrode is given by the potential difference between the waveform applied to that row electrode and the waveform applied to that column electrode. The row electrode to which a strobe waveform is being applied is termed the 'selected row' or 'selected electrode'.

Figure 1:
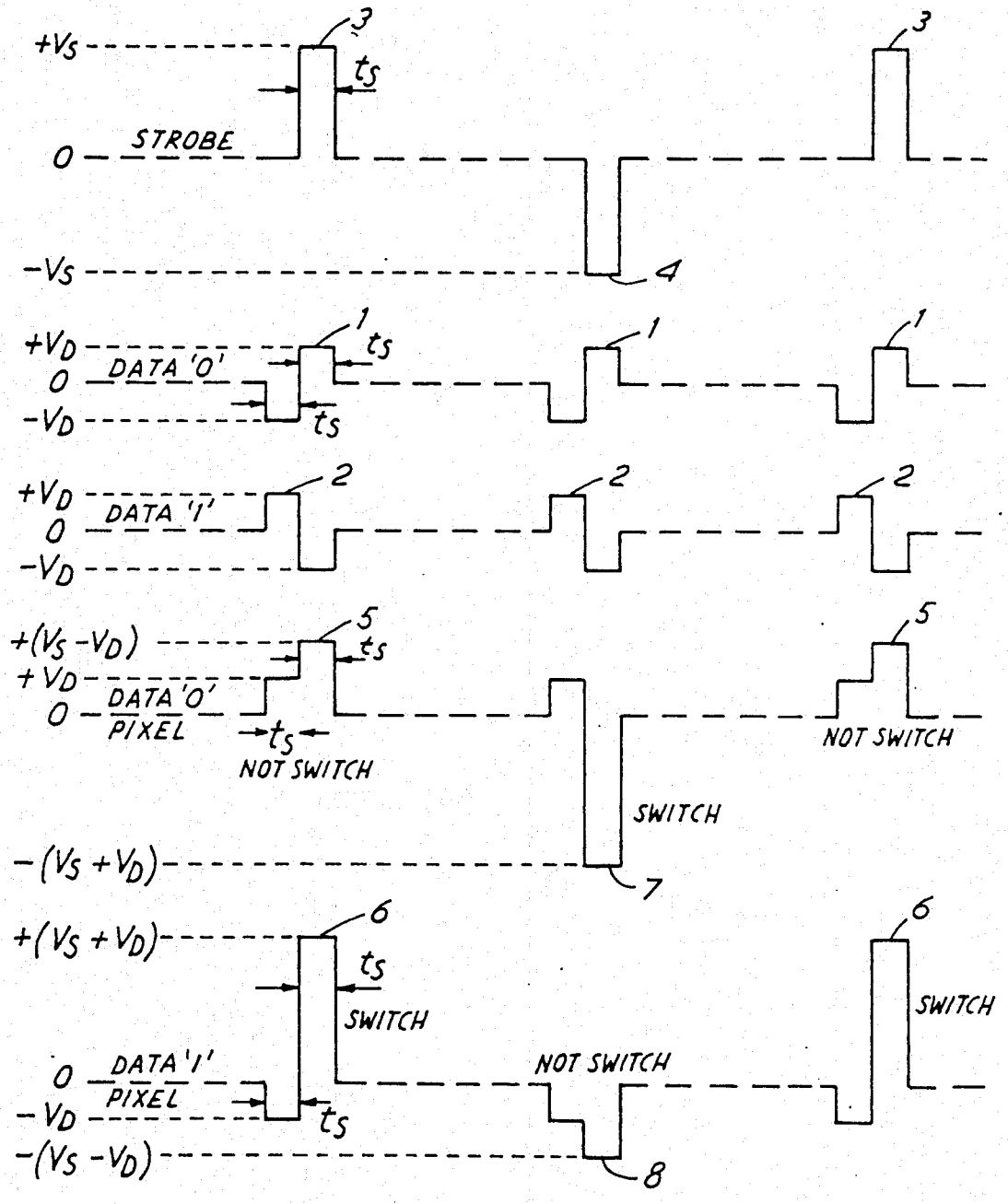
FIG. 1 (PRIOR ART)
FIG. 1 depicts waveforms employed in addressing a liquid crystal cell on co-ordinate basis and in a known method.
Figure 2:
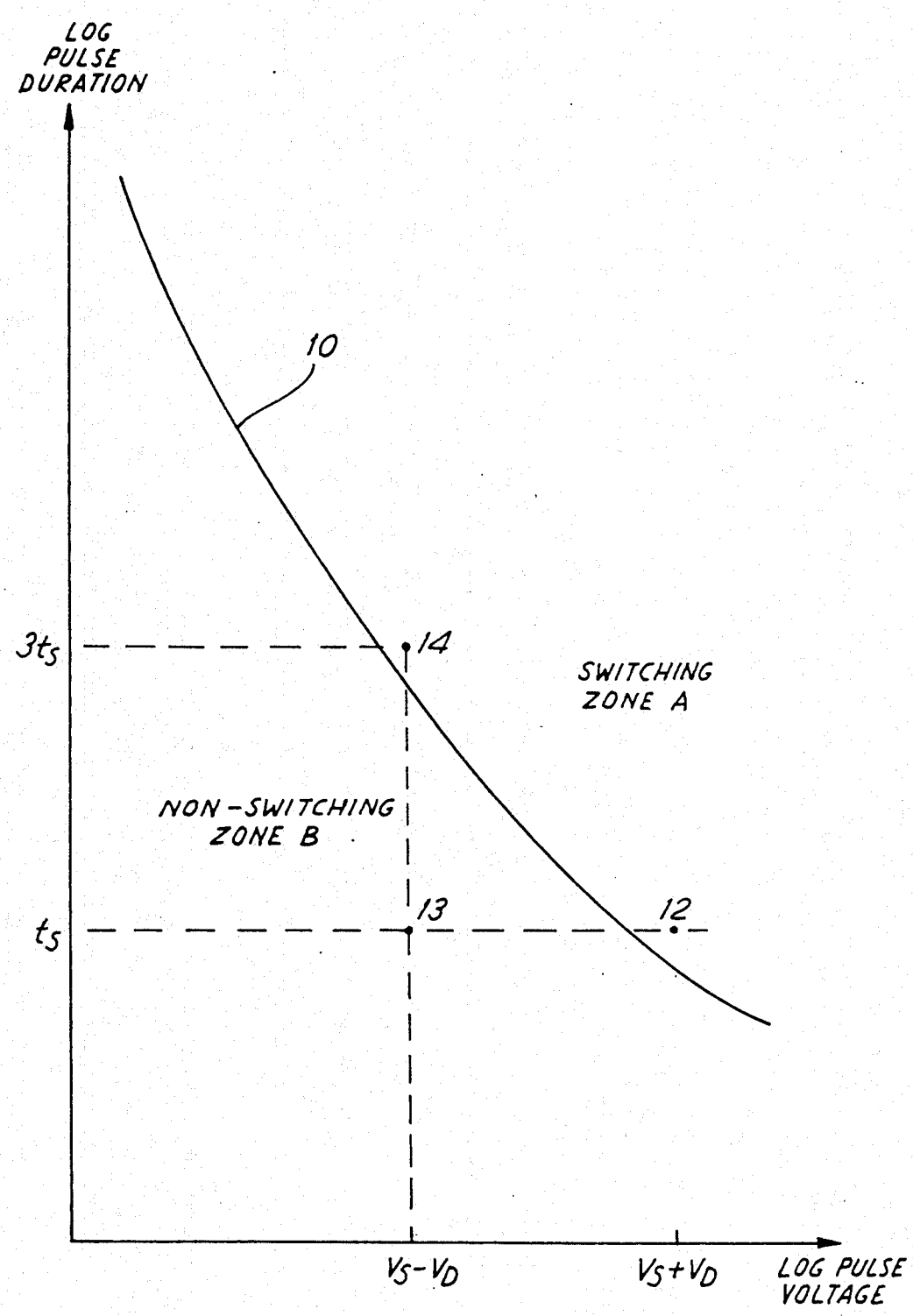
FIG. 2 (PRIOR ART)
FIG. 2 is a graph depicting a switching characteristic relating pulse duration with pulse amplitude necessary to effect switching in a known method.
Figure 3:
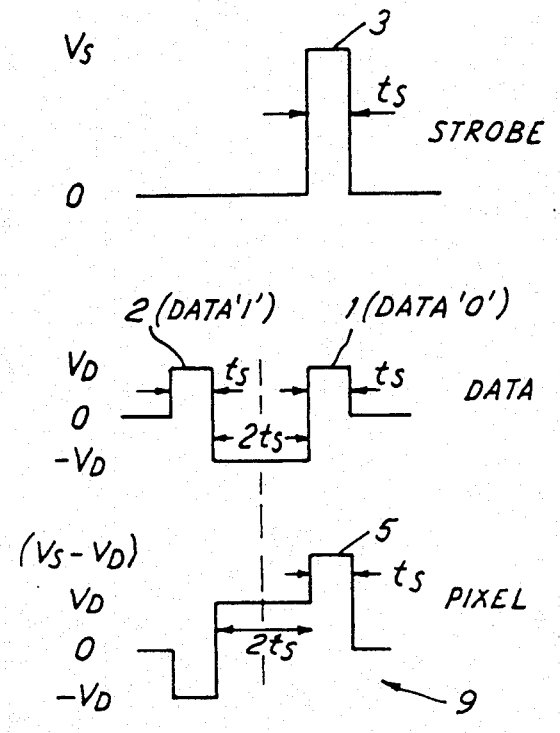
FIG. 3 (PRIOR ART)
FIG. 3 depicts waveforms produced in the scheme of FIG. 1.

A scheme for addressing the liquid crystal cell by the method of the present invention is depicted in FIG. 7. This scheme is similar to that depicted in FIG. 1 in that it uses symmetric bipolar data waveforms 41, 42 to co-act with positive going and negative-going unipolar strobe waveforms 43 and 44. However a different use is made of the waveforms produced across each pixel.

As can be seen, the data waveforms 41, 42 (arbitrarily designated data '1' and '0' waveforms respectively) are of opposite sense. Each data waveform 41, 42 is charge-balanced and bipolar, comprising data pulses of voltage magnitude $V_D$ and duration $t_s$ The strobe waveforms 43 and 44 comprise pulses of voltage $+V_S$ and $-V_S$ respectively, both of duration $t_s$. In principle, the strobe pulse 43, 44 can be synchronised with either the first or second pulse of the data waveforms; synchronisation with the second pulse is exemplified in the present instance.

FIG. 7 also shows the resulting waveform produced across a pixel 36*aa* defined by a selected row electrode 37*a*, to which a strobe waveform has been applied, and a column electrode 38*a*, to which a data waveform has been applied. In the case where a positive strobe waveform has been applied to the selected row electrode 37*a*, the application of a data '1' waveform 41 to the column electrode 38*a* produces a positive switching pulse 45 of duration $2t_s$ including a positive component 45*a* of voltage magnitude $(V_S-V_D)$ while the application of a data '0' waveform 42 produces a non-switching waveform 46 including a positive non-switching pulse 46*a* of voltage magnitude ($V_S+V_D$) and duration $t_s$. Similarly in the case where a negative strobe waveform has been applied to the selected row electrode 37*a*, the application of a data '1' waveform 41 produces a negative non-switching waveform 47 including a non-switching pulse 47*a* of voltage magnitude ($V_S+V_D$) and duration ts while the application of a data '0' waveform 42 produces a negative switching pulse 48 of duration $2t_s$ including a negative component 48*a* of voltage magnitude ($V_S-V_D$). On the selected rows to which a strobe waveform is not being applied, the resulting waveform across the pixels is simply the data waveform as applied to the respective column electrodes, but inverted, which is not capable of switching the pixel.

Accordingly with reference also to FIG. 4, the pulses 45, 48 of duration $2t_s$ and comprising a component 45*a*, 48*a* of voltage magnitude ($V_S-V_D$), have an operating point in switching zone C and so are switching pulses. The pulses 46*a*, 47*a* of duration $t_s$, less than $2t_s$, and voltage magnitude ($V_S+V_D$), greater than ($V_S-V_D$), have an operating point in the non-switching zone D and so are non-switching pulses. The pulses $V_D$ of duration $t_s$ in the data waveforms (on the non-selected rows) have an operating point in the non-switching zone E.

When using the strobe and data pulses of FIG. 6 a complete refreshing of the cell requires two addressing cycles, one with positive-going strobe pulses 43 which are used for selectively switching those pixels required to be switched into their data '1' states, and the other with negative-going strobe pulses 44 which are used for selectively switching those pixels required to be switched into their data '0' states. As an alternative to this form of selective switching performed twice over, a blanking operation may be employed in which all the pixels of a line, group of lines, or the entire page, may be set simultaneously into one of the data states, this blanking being followed by a single selective addressing for switching only those pixels required to be set into the other data state.

It can be seen from curve 20 of FIG. 4 that, by arranging the pulse durations and voltages such as to provide an operating point for ($V_S-V_D$) lying safely inside curve 20 near its positive gradient, the fulfilling of the requirement that $V_D$ shall not be too small in relation to $V_S$ serves to assist the discrimination afforded by the addressing method.

Another analysis of the inter-relationship of pulse duration and pulse voltage magnitude is depicted in FIG. 8 and described with respect to the waveform scheme of FIG. 7. The pulse 45, 48 of FIG. 7 can be considered as being formed of two components, the component 45*a*, 48*a* which is immediately preceded by a component 45*b*, 48*b* of the same polarity but a smaller amplitude $V_D$. The waveform 46, 47 can also be considered as being formed of two components,—in fact, pulses—the pulse 46*a*, 47*a* which is immediately preceded by a pulse 46*b*, 47*b* of the opposite polarity and a smaller amplitude $V_D$. A pixel exposed to an isolated pulse of constant pulse height has a characteristic curve e.g. as depicted at 50. A pixel exposed to a pulse component immediately preceded by a pulse component of the same polarity but a smaller amplitude $V_D$ has a characteristic given by a curve of shape similar to curve 50 but translated downwardly and slightly to the right with respect thereto, such as curve 51. A pixel exposed to a pulse immediately preceded by a pulse of the opposite polarity and a smaller amplitude $V_D$ has a characteristic given by a curve of shape similar to curve 50 but translated upwardly and slightly to the left with respect thereto, such as curve 52.

Now considering operation when multiplexing with waveforms as depicted in FIG. 7, ($V_S-V_D$) is preceded by a component of the same polarity, 45*b*, 48*b*, and it will have a switching characteristic as shown in curve 51. ($V_S+V_D$) is preceded by a pulse of opposite polarity, 46*b*, 47*b* and it will have a switching characteristic as shown in curve 52. By arranging the pulse durations and voltages such as to provide an operating point 54 for ($V_S-V_D$) inside the curve 51 corresponding to a pulse duration less than that of the minimum of curve 52 then the operating point for ($V_S+V_D$) cannot lie within curve 52 and hence cannot lead to spurious switching.

Even though ($V_S+V_D$) cannot itself lead to spurious switching, there is still the requirement that signals other than ($V_S+V_D$) and ($V_S-V_D$) should not give rise to spurious switching. FIG. 9 shows the resulting waveforms across the pixels 36*aa*, 36*ab*, 36*ac*, 36*ad*, 36*ba*, 36*bb*, 36*bc* and 36*bd* when data waveforms are applied to the column electrodes 38*a*, 38*b*, 38*c* and 38*d* while waveforms including strobe pulses are applied to the row electrodes 37*a* and 37*b*. (The reference in brackets below a waveform indicates to which electrode it has been applied or across which pixel it has been produced). In effect, the Figure shows, for a positive strobe pulse, the possible waveforms that can be produced when, on a column electrode, a data waveform to produce a switching or non-switching waveform is preceded or followed by either one of the possible data waveforms '0' or '1'.

Waveforms which may lead to spurious switching are those across pixels referenced at 36*ad* and 36*bb* and those produced across pixels on rows unselected for two line address times and having the data waveform combinations referenced as 38*b* and 38*d*. The risk of the waveform at 36*ad* switching incorrectly can be eliminated by ensuring that the characteristic curve of the liquid crystal material used has a steep positive gradient so that pulses 30 including a pulse component of voltage magnitude ($V_S+V_D$) and a duration of $t_s$ or $2t_s$ do not switch (i.e. the operating points for durations $t_s$ and $2t_s$ are in the non-switchinq zone D). The waveforms referenced at 36*bb*, 38*b* and 38*d* each have a pulse of amplitude $V_D$ and duration $2t_s$ $V_D$ must be chosen in relation to $t_s$ to ensure that these waveforms do not switch (i.e. the operating point for a pulse of amplitude $V_D$ and duration $2t_s$ is in the non-switching zone E) and also to ensure that the resulting optical response does not seriously degrade the contrast. The ability to produce selective switching with a pulse of one amplitude inducing switching, while another pulse of the same duration but greater amplitude does not induce switching, is associated with the existence of a positive gradient portion in the characteristic curve 20 of FIG. 4. It is believed that some characteristic curves exhibit minima, and hence regions of positive and negative gradient, as the direct result of the conflicting torques arising from the interaction of an applied electric field (E) with the dielectric anisotropy ($\Delta\epsilon$) and with the spontaneous polarisation ($P_s$) contributions to the electrostatic free energy ($F_e$). FIG. 10 shows that the electric field E is applied between the members of the first set of electrodes in the electrode layer 34 and the members of the second set of electrodes in the electrode layer 35. Referring still to FIG. 10, if $\theta$ is the tilt angle of the smectic (the angle between the molecular director n and the smectic layer normal S), if $\phi$ is the azimuthal angle of the molecular director (the angle between the plane G parallel to the glass substrate containing the smectic layer normal and the plane containing both the smectic layer normal and the molecular director n), and if $\epsilon_o$ is the permitivity of free space, then the electrostatic free energy ($F_e$) is given by:

$$F_e = -P_s E \cos\phi - \frac{1}{2}\epsilon_o \Delta\epsilon E^2 \sin^2\theta \sin^2\phi$$

and the resulting torque ($\Omega$) is given by $$\Omega = \frac{\partial F_e}{\partial \phi} = P_s E \sin\phi - \epsilon_o \Delta\epsilon E^2 \sin^2\theta \sin\phi \cos\phi$$

When an electric field is applied to a pixel of the cell in such a direction as to switch the molecular director from an azimuthal angle $\phi=\pi$ (corresponding to one stable state) to the azimuthal angle $\phi=0$ (corresponding to the other stable state), the pulse duration required to accomplish this switching will be dependent upon the torque ($\Omega$). From experimental studies it appears that the minimum required pulse duration for an isolated pulse occurs at a value of applied electric field ($E_{min}$) that is approximately such as to give rise to the maximum slope of the torque close to $\phi=\pi$.

Thus the electric field that provides minimum required pulse duration occurs when:

$$\frac{\partial}{\partial E}\left(\frac{\partial \Omega}{\partial \phi}\right) = 0 \quad \text{for } \phi = \pi$$

$$\frac{\partial \Omega}{\partial \phi} = P_s E \cos\phi - \epsilon_o \Delta\epsilon E^2 \sin^2\theta \cos 2\phi$$

$$\frac{\partial}{\partial E}\left(\frac{\partial \Omega}{\partial \phi}\right) = P_s \cos\phi - 2\,\epsilon_o \Delta\epsilon E \sin^2\theta \cos 2\phi$$

when $$\phi = \pi \quad \text{and} \quad \frac{\partial}{\partial E}\left(\frac{\partial \Omega}{\partial \phi}\right) = 0 \qquad (1)$$

$$E = E_{min} = -P_s/(2\epsilon_o \Delta\epsilon \sin^2\theta)$$

If switching does not take place from $\phi=\pi$ to 0 but over a reduced azimuthal angle then $E_{min}$ will be shifted to a higher voltage and ultimately will not occur at all. Thus it can be seen that the purpose of the opposite polarity pulse, or AC bias (see FIG. 12), is to drive, or hold, respectively, the director in a condition in which $\phi$ approaches 0 or $\pi$.

Equation (1) indicates that the value of $E_{min}$ is dependent upon $P_s$ and $\Delta\epsilon$ which are properties of the liquid crystal material used. Accordingly, a suitable ferroelectric liquid crystal material for use in a matrix-array type liquid crystal cell addressed by the method of the present invention is one for which the values of $P_s$ (spontaneous polarisation) and $\Delta\epsilon$ (dielectric anisotropy) are such that $E_{min}$ exists and has a suitable value.

Dependence of $E_{min}$ upon $P_s$ is illustrated in FIG. 11 which shows the characteristics measured at 20° C. in a 2 $\mu$m. thick cell for a set of mixtures all having the same negative dielectric anisotropy ($\Delta G\chi - 1.9$) but different values of $P_s$. The different $P_s$ values were obtained by diluting a specific fluorinated biphenyl ester ferroelectric material supplied by BDH of Poole, Dorset and identified as M679 with different proportions of a racemic version of the same ester identified as M679R, as follows:

| Curve | % Proportion M679 | % Proportion M679R | $P_s$/(nC/cm$^2$) |
|---|---|---|---|
| 61 | 25 | 75 | 5.5 |
| 62 | 35 | 65 | 7.5 |
| 63 | 50 | 50 | 13.5 |
| 64 | 75 | 25 | 18 |

The transition temperatures for this material are $$S_C-(96°\ C.)-S_A-(114°C.)-N-(145°\ C.)-I$$

These characteristic curves are for isolated pulses and were obtained using a waveform schematically depicted at 60 comprising pulses of alternating polarity with a pulse repetition frequency of 20 Hz. The curves illustrate that with a $P_s$ of about 5.5 nC/cm$^2$ (55 $\mu$C/m$^2$) for a material with a dielectric anisotropy $\Delta\epsilon \approx -1.9$, $E_{min}$ is fairly sharply defined, occuring at a pulse duration (response time) in the neighbourhood of 200 $\mu$s at a field strength of about 15 volts/$\mu$m. When the value of $P_s$ is increased to about 7.5 nC/cm$^2$ (75 $\mu$C/m$^2$), $E_{min}$ is less sharply defined and occurs at a response time in the neighbourhood of 80 $\mu$s at a field strength of about 20 volts/$\mu$m. By increasing the value of $P_s$ to 13.5 nC/cm$^2$ (135 $\mu$C/m$^2$) the response time at a field strength of 25 volts/$\mu$m is less than 30 $\mu$s, but $E_{min}$ appears to be somewhat higher.

Reverting attention to Equation (1), if speed of addressing a display is of particular importance, the values of the strobe and data pulse voltages are chosen so that ($V_S - V_D$) develops a field strength substantially matched with $E_{min}$. Having regard to the limitations of drive circuitry, it is typically found desirable to employ pulse amplitudes for $V_S$ and for $V_D$ not exceeding about 50 volts and hence, respecting this limitations, for a given value of cell thickness and liquid crystal tilt angle $\theta$, the derived formula for $E_{min}$ there is seen to be a limited upper value to the value of the ratio $P_s/\Delta\epsilon$.

The characteristic curves of FIG. 11 were obtained using isolated pulses, but in the normal line-by-line addressing of the pixels of a display, as illustrated in the waveform scheme of FIG. 7, there is liable to be a continuous data stream which produces the effect of setting the addressing pulses against a background of alternating potential. This modifies the characteristic curves to those depicted in FIG. 12 which shows the effect of increasing the amplitude of the background alternating potential. Traces 70, 71, 72 and 73 depict characteristic curves for the 25% M679:75% M679R mixture of FIG. 11. Trace 70 depicts the characteristic curve using the waveform 60 of FIG. 11 in the presence of no background alternating potential, while curves 71, 72 and 73 depict the characteristic curves using the waveform 60 in the presence of a background alternating potential respectively of ±4 volts, ±6 volts and ±8 volts, this background alternating potential having a fundamental periodicity equal to twice the pulse duration. Traces 75, 76, 77, and 78 depict characteristic curves corresponding to traces 70 to 73, but in respect of a 50% M679:50% M679R mixture instead of the 25%:75% mixture. From these curves it is seen that one of the effects of a background alternating potential is to increase the response time. This is not generally an advantage, but another effect can be to sharpen up the minimum as particularly illustrated in the case of the 50%:50% mixture, and this is beneficial.

Accordingly, a factor which may be taken into account when choosing appropriate values of strobe and data pulse voltages, is that the data stream applied in parallel to all the column electrodes provides the non-addressed pixels with an alternating voltage component that tends to stabilise the non-addressed pixels in their fully switched states. If the amplitude of this stabilising field is too small to be effective on its own, it may be supplemented with an additional alternating signal. Such a signal can be applied as an A.C. waveform superimposed on the waveform applied across the pixels and having a frequency equal to or greater than the fundamental frequency of the data waveform. Typically, the frequency of the AC signal is an even multiple of the fundamental frequency.

Mention should also be made of the fact that the characteristic of a ferroelectric liquid crystal material is more accurately represented by the curve 80 of FIG. 13. The shaded region 82 represents combinations of pulse duration and voltage magnitude which can cause only part$_s$ of a pixel to switch. As shown in FIG. 13, the shaded region 82 is narrow when the gradient of the curve 80 is steep and broader when the gradient is more shallow. Accordingly, the risk of partial switching in the method of the present invention is reduced if the characteristic of the material used has a steep positive gradient.

What is claimed is:

1. A method of addressing a matrix-array type liquid crystal cell with a ferroelectric liquid crystal layer having a plurality of pixels defined by areas of overlap between members of a first set of electrodes on one side of the liquid crystal layer and members of a second set of electrodes on the other side of the liquid crystal layer, each of said pixels having a first and second state and a response time for switching between said first and second state which depends on the voltage across the liquid crystal layer, said response time showing a minimum at a particular voltage; the method including the step of applying a strobe waveform to a selected member of said first set of electrodes, which strobe waveform comprises a strobe pulse of voltage magnitude $V_s$, while a data waveform is applied to each member of said second set of electrodes, said data waveform being charge-balanced and bipolar and comprising data pulses of voltage magnitude $V_D$, wherein a waveform for switching a pixel defined by said selected member comprises a switching pulse of voltage magnitude, $(V_s-V_D)$, and given duration, and a waveform for not switching a pixel defined by said selected member comprises a non-switching pulse of voltage magnitude, $(V_s+V_D)$, which magnitude is greater than said given voltage magnitude of said switching pulse and a duration less than said given duration of said switching pulse.

2. A method according to claim 1 wherein said strobe waveform is unipolar.

3. A method according to claim 2 wherein said switching pulse comprises said component of voltage magnitude $(V_S-V_D)$ preceded by another component of voltage magnitude $V_D$.

4. A method according to claim 2 wherein said non-switching pulse of voltage magnitude $(V_S+V_D)$ is preceded by a pulse of voltage magnitude $V_D$.

5. A method according to claim 2, wherein the polarity of the unipolar strobe waveform is periodically changed.

6. A method according to claim 1 said data waveform having a fundamental frequency, wherein an A.C. waveform is superimposed on the waveform applied to said pixels, said A.C. waveform having a frequency greater than said fundamental frequency.

7. A method according to claim 1 wherein $V_s$ and $V_D$ are such that $(V_s-V_D)$ is substantially matched with the voltage required to effect switching with the minimum response time.

* * * * *